US006084193A

United States Patent [19]

Pellon

[11] Patent Number: 6,084,193

[45] Date of Patent: Jul. 4, 2000

[54] ELECTRICAL CIRCUIT INTERRUPTION DEVICE HAVING IMPROVED ARC EXTINGUISHING APPARATUS INCLUDING AN ARC PADDLE

[75] Inventor: Nicholas V. Pellon, Attleboro, Mass.

[73] Assignee: Texas Instruments Incorporated, Dallas, Tex.

[21] Appl. No.: 09/351,565

[22] Filed: Jul. 12, 1999

Related U.S. Application Data

[60] Provisional application No. 60/103,391, Oct. 7, 1998.

[51] Int. Cl.[7] ..... H01H 9/30; H01H 33/04

[52] U.S. Cl. ..... 218/117

[58] Field of Search ..... 218/1, 151; 20/61.19, 20/506

[56] References Cited

U.S. PATENT DOCUMENTS

| | | | |
|---|---|---|---|
| 2,697,212 | 12/1954 | Castelli | 218/117 X |
| 4,752,660 | 6/1988 | Yokoyama et al. | 218/117 |
| 4,780,697 | 10/1988 | Cobb, III et al. | 337/70 |
| 4,827,233 | 5/1989 | Cobb, III et al. | 335/201 |
| 4,939,495 | 7/1990 | Peterson et al. | 337/70 |
| 5,257,001 | 10/1993 | Truchet et al. | 337/79 |

*Primary Examiner*—J. R. Scott

*Attorney, Agent, or Firm*—Russell E. Baumann; Frederick J. Telecky, Jr

[57] ABSTRACT

A circuit interrupter in the form of a circuit breaker (10) is shown having a movable contact (14*a*) which moves between contacts engaged and contacts disengaged position relative to a stationary contact (16*a*). An arc paddle (20) is mounted in a housing (12) for spring biased pivotal motion of an arc dissipating portion between a position out of alignment with the movable and stationary contacts and in engagement with the side of the movable contact when the contacts are in the contacts engaged position and a position in which the arc dissipating portion is in alignment with and in between the contacts when the contacts are in the contacts disengaged position to force arcs which occur between the contacts to extend their travel path and dissipate the arc in an improved shortened period of time. In an alternative embodiment the arc paddle (22) is generally U-shaped having two legs (22*a*, 22*b*) connected by a bight (22*c*). The paddle is pivotably mounted at the bight with one leg disposed in alignment with but beyond the contacts and the other leg disposed out of alignment with the contacts and closely adjacent the side of the movable contact when the contacts are in engagement. When the movable contact separates from the stationary contact, motion is transferred to the one leg causing the paddle to pivot with other leg moving into alignment with and in between the two contacts.

15 Claims, 4 Drawing Sheets

ELECTRICAL CIRCUIT INTERRUPTION DEVICE HAVING IMPROVED ARC EXTINGUISHING APPARATUS INCLUDING AN ARC PADDLE

This application claims priority under 35 USC Section 119 (e) (1) of provisional application No. 60/103,391 filed Oct. 7, 1998.

FIELD OF THE INVENTION

This invention relates generally to electrical circuit interruption devices such as circuit breakers, switches, relays and the like and more particularly to such devices having improved arc extinguishing means.

BACKGROUND OF THE INVENTION

Thermally responsive switches such as circuit breakers interrupt electrical circuits in response to the occurrence of selected overload conditions in the circuits to protect other equipment from damage due to overheating, overcurrent or the like. An example of such a switch is shown in U.S. Pat. No. 4,780,697, assigned to the assignee of the present invention. As shown and described in the patent, a movable contact and a complimentary stationary contact cooperate with a control mechanism for normally holding the movable contact in engagement with the stationary contact in a closed circuit position. The control mechanism includes a current carrying thermally responsive bimetallic member having substantial electrical resistance properties adapted to conduct load current so that overload current flowing in the circuit for a selected period time self heats the bimetallic member causing it to flex and trip the control mechanism to open the circuit in a conventional manner.

It is known to use a grid system or similar structure placed adjacent to the electrical contacts in such devices in order to dissipate the energy of arcs which occur upon circuit interruption as the movable contact moves away from the stationary contact in order to minimize overheating and concomitant damage to the contacts. One example of this approach is shown and described in the above referenced U.S. Pat. No. 4,780,697 which also provides certain structures for mounting the contacts to form a selected loop to thereby electromagnetically direct arcs between the contacts away from the movable contact into an arc chute. These improvements resulted in being able to replace tungsten contact material in such circuit breakers with silver cadmium oxide for improved performance. However, even with such improvements the silver in the silver cadmium oxide contacts tend to erode when subjected to endurance cycling. Due to the limited amount of silver present in silver cadmium contacts, erosion of the silver increases the contact resistance eventually causing a situation in which the device fails to trip open after a certain number of cycles.

Some circuit interruption devices which have two pairs of contacts providing a double break can use cadmium free contacts; however, for many applications a single break device is preferred due to certain advantages such a device offers, including higher available contact forces, lower overall voltage drop and lower cost.

SUMMARY OF THE INVENTION

It is an object of the invention to provide an improved circuit interruption device which overcomes the above noted prior art limitations. Another object of the invention is the provision of a circuit interruption device which has improved arc quenching structure. Yet another object of the invention is to provide a single break circuit interruption device which employs low contact resistance material for both the movable and stationary contacts.

Briefly stated, a circuit interrupter made in accordance with the invention comprises at least one stationary electrical contact and a mating movable electrical contact mounted in a housing with the movable electrical contact being movable between contacts engaged and contacts disengaged positions, an arc paddle mounted in the housing having a portion movable from a position out of alignment with the contacts when the contacts are in the contacts engaged position to a position in alignment with and in between the contacts when the contacts are in the disengaged position. According to a feature of one preferred embodiment, the arc paddle is pivotably mounted in the housing and spring biased against the movable contact structure so that upon opening movement of the movable contact the arc paddle instantly moves to a position intermediate to the movable and stationary contacts. According to a preferred embodiment the arc paddle is composed of relatively high resistance metal, such as stainless steel. In another preferred embodiment, the arc paddle is formed of plastic material with a metal insert for that portion of the paddle which moves between the contacts.

In another preferred embodiment, the arc paddle, which can be used when the housing of the interrupter device provides sufficient space, is formed in a generally U-shaped configuration having first and second leg portions pivotably mounted at the bight of the U-shape configuration and with the movable contact, when in the contacts disengaged position, disposed between the first and second legs. When the movable contact is moved to the contacts engaged position it engages the first leg of the paddle and causes the first leg to pivot out of alignment with the contacts and with the second leg moving to a position closely adjacent to the outer surface of the movable contact. When the movable contact moves to the contacts disengaged position, the outer surface of the movable contact engages the second leg portion causing it to pivot and at the same time causing the first leg to pivot to a position intermediate to the contacts.

BRIEF DESCRIPTION OF THE DRAWINGS

Other objects, advantages and details of the novel and improved electrical circuit interruption device of this invention appear in the following detailed description of the preferred embodiments of the invention, the detail description referring to the drawings in which.

DESCRIPTION OF THE PREFERRED EMBODIMENTS

Figure 1:
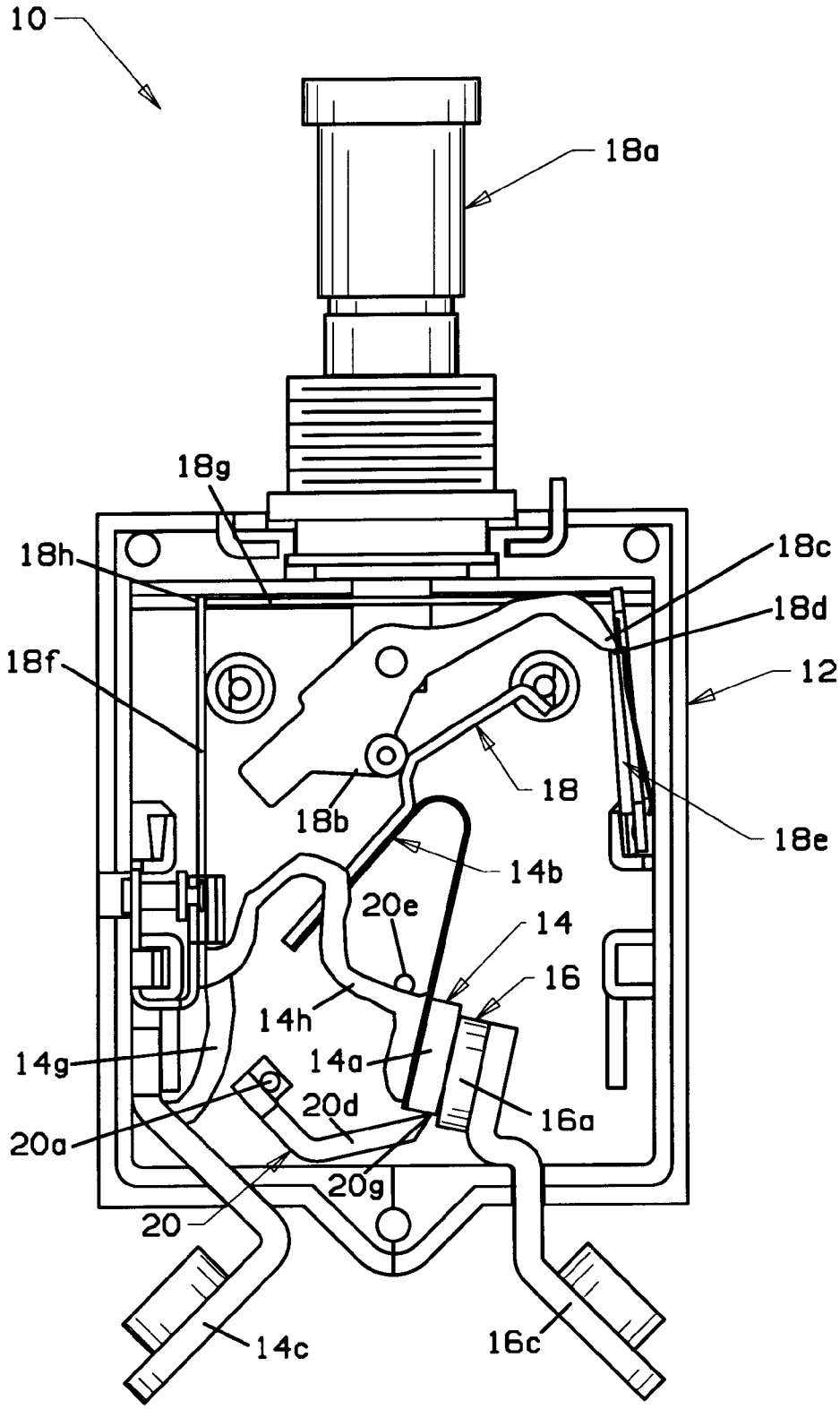
FIG. 1 is a front elevational view of a circuit breaker with the front housing half removed showing the electrical contacts in the contacts engaged position with the arc dissipating portion of the arc paddle out of alignment with the movable and stationary contacts.

Referring to FIGS. 1–4 of the drawings, a circuit interrupter 10, such as a circuit breaker, made in accordance with the invention comprises a housing 12 in which are disposed a movable contact means 14, a stationary contact means 16 and a control mechanism 18, the control mechanism including thermal responsive bimetallic means 18*f*. The control mechanism normally holds the movable contact means 14 in engagement with stationary contact means 16 to close the circuit breaker as shown in FIG. 1. The thermally responsive bimetallic means has substantial electrical resistance properties and is adapted to conduct current to self heat and to flex to a predetermined extent in response to the flow of a selected overload current in the circuit breaker for a given period of time. When the thermally responsive bimetallic means flexes to that extent it is adapted to trip mechanism 18 through motion transfer member 18*g*, as described below, to move the movable contact means 14 out of engagement with the stationary contact means to open the circuit breaker in a conventional manner. The control mechanism, including push-pull button 18*a*, is also adapted to manually move the movable contact means into and out of engagement with the stationary contact means, to releasably latch the movable contact means to the open circuit position when the movable contact is moved to that position either manually or in response to the occurrence of an overload circuit, to permit the circuit breaker to be manually reset after manual opening or after normal opening in response to overload currents if the bimetallic means has cooled, to be compensated for variations in ambient temperature in its normal thermal response to the occurrence of an overload current in the breaker circuit and to be trip free.

Figure 2:
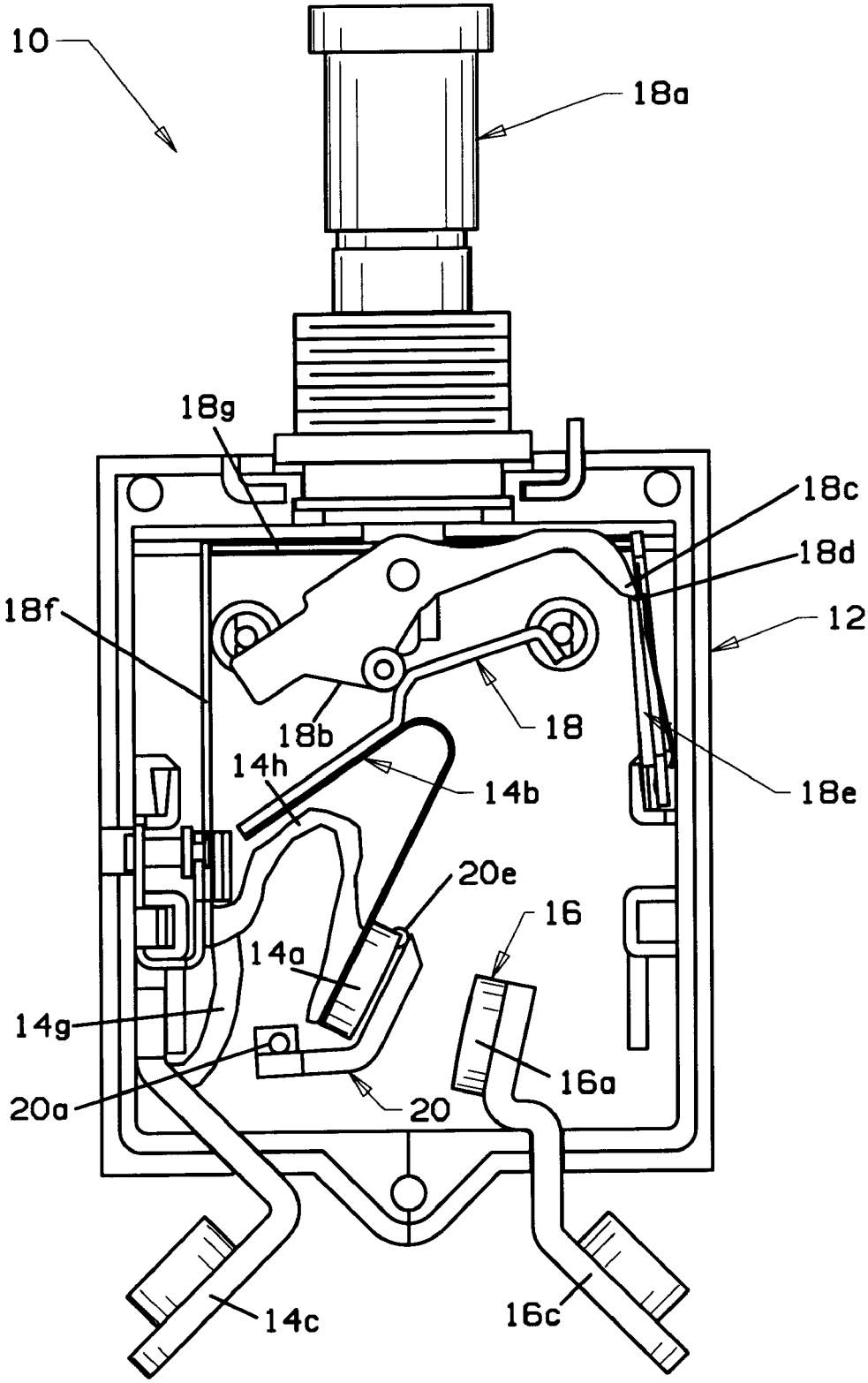
FIG. 2 is a view similar to FIG. 1 shown with the electrical contacts in the contacts disengaged position with the arc dissipating portion of the arc paddle moved to a position in alignment with and between the movable and stationary electrical contacts.

The control mechanism includes a belt crank 18*b* having a latch 18*c* which cooperates with a latch reaction surface 18*d* of a bimetal thermal compensation assembly 18*e*. When latch 18*c* is received on reaction surface 18*d* the push button 18*a* can be depressed with its motion transferred to movable arm and spring assembly 14*b* causing the movable contact 14*a* of movable contact means 14 to move into engagement with stationary contact 16*a* of stationary contact means 16 as shown in FIG. 1. Movable contact means 14 is electrically connected to terminal 14*c* through bimetallic means 18*f*. Bimetallic means 18*f* may be shaped in a generally U-configuration with one leg connected to terminal 14*c* through a suitable electrically conductive pigtail 14*g* and the other leg connected in turn to movable arm and spring assembly 14*b* through a similar pigtail 14*h*, or the like. Stationary contact 16*a* is electrically connected to terminal 16*c* as by welding thereto. When reaction surface 18*d* is caused to move to the right, as seen in FIG. 2, by means of motion transferred through motion transfer member 18*g* from the bight 18*h* of current carrying bimetal 18*f* of the control mechanism, the movable arm and spring assembly 14*b*, along with movable contact 14*a*, are moved into the contacts disengaged position away from the stationary contact 16*a* as shown in FIG. 2. Further details of the operation of this type of control mechanism can be obtained by reference to the above cited U.S. Pat. No. 4,780,697, the subject matter of which is included herein by this reference.

Figure 3:
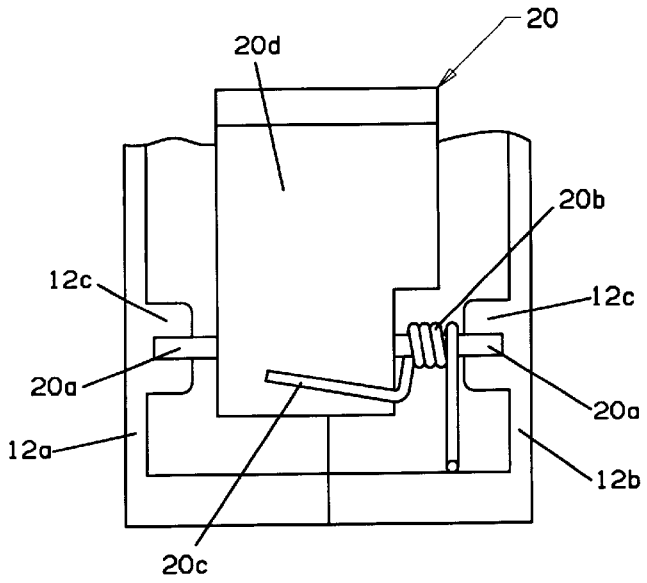
FIG. 3 is an enlarged side elevation of the arc paddle and mounting thereof shown in the FIG. 2 position.
Figure 4:
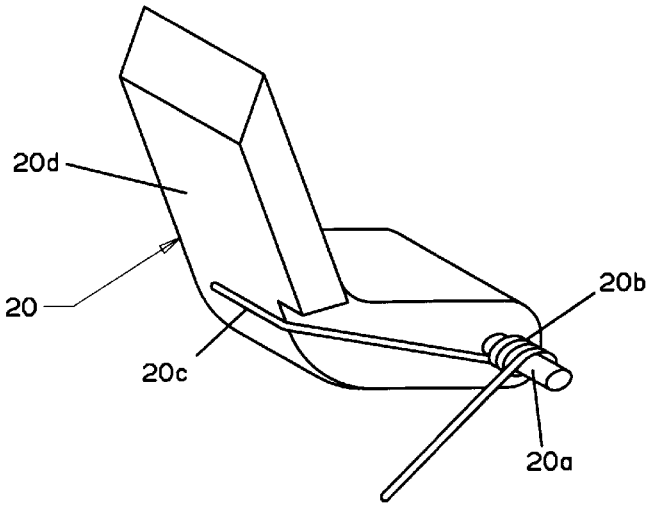
FIG. 4 is a perspective view of the FIG. 3 arc paddle.

With particular reference to FIGS. 3, 4, in accordance with a first embodiment of the invention, an arc paddle 20 is pivotably mounted on pins 20*a* journaled in bosses 12*c* formed in opposed housing halves 12*a*, 12*b*. A spring 20*b* is also mounted on pin 20*a* with an end portion 20*c* placing a bias on arc paddle 20 in a clockwise direction as seen in FIG. 4 and counterclockwise as shown in FIGS. 1, 2. The arc paddle is formed with an arc dissipating portion 20*d* which is biased against the side of movable contact 14*a* when the contacts are in the contacts engaged position as shown in FIG. 1 and which instantly pivots into a position aligned with and in between the movable and stationary contacts when the movable contact moves to the contacts disengaged position shown in FIG. 2. Movement of arc paddle 20 is preferably limited by stop pin 20*e* extending from the sidewall of housing 12 to prevent possible welding of the arc paddle to the movable contact. Arc paddle 20 is preferably formed of a metallic material as shown in FIGS. 3, 4 and which, advantageously, may have a relatively high resistivity, such as stainless steel or arc paddle 20' may be formed of ceramic or of plastic material with a metal insert 20*f*, e.g., stainless steel, shown in FIG. 5. Use of high resistance material decreases eddy currents and the like and tends to result in a lower operating temperature of the arc paddle. Arc dissipating portion 20*d* is preferably chosen to be sufficiently long in a direction extending from the pivot at 20*a* to its free distal end 20*g* so that it is completely interposed between the contacts when in the contacts disengaged position so that any arc which occurs between the contacts is forced to travel a longer path in going between the contacts thereby hastening dissipation of the arc. Movement of movable contact 16*a* in the contacts closing direction will cause arc paddle 20 to pivot against the bias of spring 20*b* to be held at a cocked position by engagement with the side of the movable contact. Devices made in accordance with the invention have been effective in quenching arcs as quickly as 7 milliseconds, up to several times faster than in devices not provided with an arc paddle.

Figure 5:
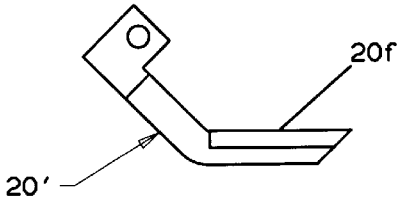
FIG. 5 is a front elevational view of a modified arc paddle useful in the FIGS. 1, 2 embodiment.
Figure 6:
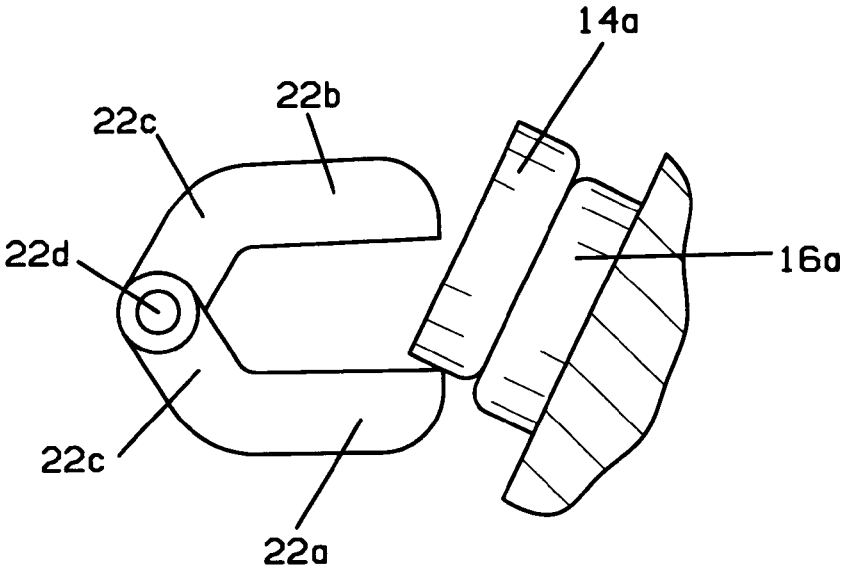
FIG. 6 is a front elevational view of an arc paddle made in accordance with another preferred embodiment along with a movable stationary and electrical contact shown in the contacts engaged position, the remaining structure of the circuit interrupter not shown for purposes of illustration.
Figure 7:
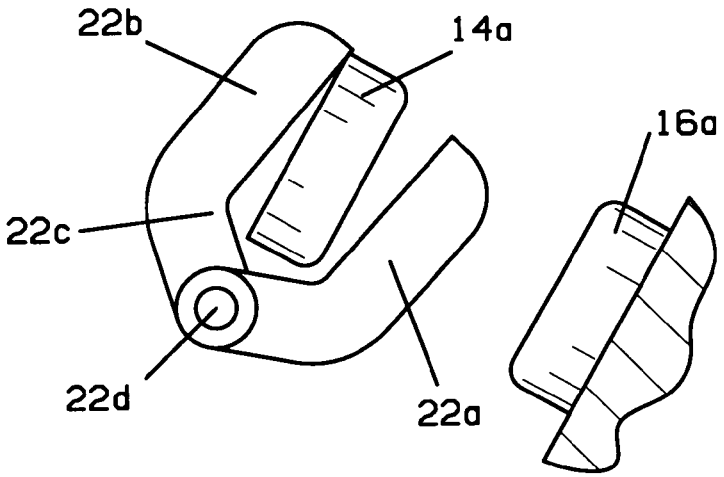
FIG. 7 is a view similar to FIG. 6 shown with the electrical contacts in the contacts disengaged position.

FIGS. 6 and 7 are directed to an alternative embodiment in which arc paddle 22 is generally U-shaped having first and second leg portions 22*a*, 22*b* joined at bight 22*c* which is pivotably mounted at 22*d*. First leg 22*a* serves as an arc dissipating portion and is out of engagement with the contacts and closely adjacent movable contact 14*a* when the contacts are in the contacts engaged position. When the contacts separate the back of movable contact 14*a* will transfer motion to leg 22*b* causing the arc paddle to pivot counterclockwise as seen in FIGS. 5 and 6 and bring leg portion 22*a* into alignment with and in between the movable and stationary contacts. Thus in the FIGS. 6, 7 embodiment, a separate biasing spring is not required; however, more space is required to accommodate the U-shaped paddle and its pivotal mounting so that the arc dissipating leg extends across the path between the two contacts, as shown.

It should be understood that although particular embodiments of a current interrupter have been described by way of illustrating the invention, this invention includes all modifications and equivalents of the disclosed embodiments falling within the scope of the appended claims. For example, although pivotal motion is described for the arc paddles, it will be understood that rectilinear motion could also be used. The term circuit interrupt as used herein encompasses any type of electrical mechanism having an electrical contact movable into and out of electrical engagement with a mating electrical contact to make and interrupt a circuit path.

What is claimed:

1. Circuit interruption apparatus comprising a housing, a stationary electrical contact and a movable electrical contact mounted in the housing with the movable electrical contact being movable between contacts engaged and contacts disengaged positions, an arc paddle pivotably mounted in the housing and having a portion movable between a first position adjacent to the contacts and out of alignment therewith when the contacts are in the contacts engaged position to a second position in alignment with and in between the contacts when the contacts are in the contacts disengaged position.

2. Circuit interruption apparatus according to claim 1 further comprising a spring member mounted in the housing and placing a bias on the arc paddle urging the arc paddle toward the second position thereof, the arc paddle being biased against a side of the movable contact when the contacts are in the contacts engaged position.

3. Circuit interruption apparatus according to claim 2 further comprising a stop member mounted in the housing to limit travel of the arc paddle when moving toward the second position to prevent engagement of the arc paddle with the movable contact in the contacts disengaged position.

4. Circuit interruption apparatus according to claim 1 in which the arc paddle is formed of a metallic material.

5. Circuit interruption apparatus according to claim 4 in which the metallic material is stainless steel.

6. Circuit interruption apparatus according to claim 1 in which the arc paddle is formed of ceramic material.

7. Circuit interruption apparatus according to claim 1 in which the arc paddle is formed of plastic material with a metallic insert serving as the portion movable between the first and second positions.

8. Circuit interruption apparatus according to claim 7 in which the metallic insert is formed of stainless steel.

9. Circuit interruption apparatus according to claim 1 in which the arc paddle is pivotably mounted and has first and second portions, the first portion being the portion movable between a first position away from and out of alignment with the contacts in the contacts engaged position and a second position in alignment with and in between the contacts in the contacts disengaged position and the second portion being spaced from the first portion and disposed closely adjacent to and in alignment with the contacts when the contacts are in the contacts engaged position so that the movable contact moving away from the stationary contact will engage the second portion of the arc paddle transferring motion thereto causing the arc paddle to pivot with the first portion moving to the second position between the contacts in the contacts disengaged position and the movable contact moving from the contacts disengaged position to the contacts engaged position transferring motion to the first portion causing the arc paddle to pivot so that the first portion will move to the first position out of alignment with the contacts when the contacts are in the contacts engaged position.

10. Circuit interruption apparatus according to claim 9 in which the arc paddle is generally U-shaped, the U-shaped paddle having first and second legs connected by a bight in which the first and second portions form the first and second legs, respectively, and the pivot is located at the bight.

11. Circuit Interruption apparatus according to claim 9 in which the arc paddle is formed of metallic material.

12. Circuit interruption apparatus according to claim 11 in which the metallic material is stainless steel.

13. Circuit interruption apparatus according to claim 9 in which the arc paddle is formed of ceramic material.

14. Circuit interruption apparatus according to claim 9 in which the arc paddle is formed of plastic material with a metallic insert serving as the portion movable between the first position away from the contacts and the second position in between the contacts.

15. Circuit interruption apparatus according to claim 14 in which the metallic insert is formed of stainless steel.

* * * * *